US006050612A

United States Patent [19]

Wolterman

[11] Patent Number: 6,050,612

[45] Date of Patent: Apr. 18, 2000

[54] COMPOSITE ASSEMBLY HAVING IMPROVED LOAD TRANSMISSION BETWEEN A FLEXIBLE TUBULAR PIPE SECTION AND A RIGID END FITTING VIA RESPECTIVE ANNULAR COUPLING GROOVES

[75] Inventor: Daniel J. Wolterman, Lincoln, Nebr.

[73] Assignee: SpyroTech Corporation, Lincoln, Nebr.

[21] Appl. No.: 08/941,237

[22] Filed: Sep. 30, 1997

[51] Int. Cl.[7] ..... F16L 33/00

[52] U.S. Cl. ..... 285/259; 285/328; 29/428; 138/174

[58] Field of Search ..... 285/382, 256, 285/259, 328; 29/428, 508; 138/174, 172, DIG. 7; 166/242.6; 175/325.2, 325.5; 156/293, 305; 264/257, 258, 269, 274

[56] References Cited

U.S. PATENT DOCUMENTS

| | | | |
|---|---|---|---|
| 2,139,745 | 12/1938 | Goodall | 285/253 |
| 3,661,670 | 5/1972 | Pierpont, Jr. | 156/293 X |
| 3,697,141 | 10/1972 | Garrett | 175/325.5 |
| 3,722,925 | 3/1973 | Robbins | 285/55 |
| 3,768,269 | 10/1973 | Broussard et al. | 138/174 X |
| 3,860,272 | 1/1975 | Becker | 285/123.1 |
| 4,676,563 | 6/1987 | Curlett et al. | 439/194 |
| 4,848,455 | 7/1989 | Fenyvesi | 166/77.2 |
| 4,860,656 | 8/1989 | Hardwick | 102/312 |
| 4,905,856 | 3/1990 | Krogager | 220/588 |
| 5,009,737 | 4/1991 | Lescaut | 156/264 |
| 5,105,854 | 4/1992 | Cole et al. | 285/256 X |
| 5,211,429 | 5/1993 | Charlson et al. | 285/259 X |
| 5,332,049 | 7/1994 | Tew | 175/320 |
| 5,423,389 | 6/1995 | Warren et al. | 175/75 |
| 5,427,154 | 6/1995 | Stephens | 264/269 X |
| 5,853,202 | 12/1998 | Li et al. | 285/259 X |

*Primary Examiner*—Lynne H. Browne
*Assistant Examiner*—Greg Binda
*Attorney, Agent, or Firm*—Rothwell, Figg, Ernst & Kurz

[57] ABSTRACT

A composite drill pipe has an improved means of attaching a metal end fitting to a composite tubular member using corresponding annular grooves in the metal end fitting and the composite tubular member. In addition to annular grooves for axial loads, a plurality of axial grooves can also be included to accommodate greater torsional loads. The composite pipe body can also include a buildup made of a compliant rubber layer, a composite overwrap, and a wear pad in order to reduce the effective buckling node spacing to even further increase the axial load capability.

27 Claims, 7 Drawing Sheets

COMPOSITE ASSEMBLY HAVING IMPROVED LOAD TRANSMISSION BETWEEN A FLEXIBLE TUBULAR PIPE SECTION AND A RIGID END FITTING VIA RESPECTIVE ANNULAR COUPLING GROOVES

This invention was made with United States Government support under award number 70NANB5H1171 awarded by U.S. Department of Commerce, National Institute of Standards, Advanced Technology Program 95-11. The United States Government may have certain rights in the invention.

BACKGROUND OF THE INVENTION

1. Field Of the Invention

The present invention relates to drilling into ground surfaces, such as in the areas of oil well drilling and gas drilling, e.g., notably from offshore platforms. In particular, the present invention involves an improved method of connecting composite tubular drill pipes to metal end fittings.

2. Description of the Background Art

Oil and gas well drilling in offshore environments has traditionally been dominated by vertical and near vertical well bore trajectories. By increasing the ability to depart from vertical trajectories, a larger field of oil or gas can be produced from a single operating platform. By drilling at an angle (i.e., a "sail angle") of, for example, 75° from vertical, the weight of the drill string is used to push against the cutting bit. When the sail angle is increased toward being horizontal, the weight of the drill string develops frictional forces against the formation (e.g., against the ground) that resist the desired action of pushing ahead. As a result, the capacity to bore through the formation is lost.

During the drilling process, a heavy fluid (e.g., a "drilling mud") is pumped through the central bore of the drill pipe and through orifices in the drill bit. The fluid then returns through the annulus between the drill pipe and the bore hole. The drill pipe, which is typically steel and much heavier than the liquid or drilling mud, rests against the bottom side of the bore and significant friction develops between the drill pipe and the bore. By controlling the density of the composite drill pipe, a buoyant force can be used to reduce the effective weight of the drill pipe against the formation. As a result, the amount of friction can be reduced.

One known composite drill pipe is shown in U.S. Pat. No. 5,332,049. The '049 patent drill pipe enables boring deviated wells using a short radius of curvature with a limited reach. The '049 patent shows a method of transferring loads between a composite pipe body and a metal end fitting that consists of both an adhesive bond and mechanical pins. This method of attachment has a number of drawbacks. For example, by using a hard bonding and mechanical pins, if the fitting is compromised during drilling operations to the point of failure, there is no means to pull the drill string out of the bore hole. In addition, the overall strength of the fitting is limited. As one example, there is no effective method to ensure that the adhesive is loaded evenly.

As discussed in the '049 patent, the disclosure of which is incorporated herein by reference, extended reach drilling technology uses a drilling string consisting of a series of drill pipes. Typically, the drill pipes are made of steel, but other materials such as aluminum have been used. Drilling at a sail angle is used to balance the beneficial effect of gravity in pushing on the drilling bit and the creation of friction along the formation wall. However, as the bore progresses outward, it also moves deeper. As a result, the trajectory may not intersect the oil pay zones.

Another problem with the drill pipe in the '049 patent is that it is not appropriate for extended reach drilling. The disclosed drill pipe is designed to be rather flexible and, thus, has a rather low stability threshold. Friction buildup is not eliminated, and, eventually, the axial loads in the drill string build up to a point where the pipe loses stability and begins to buckle. Once the buckling commences, the boring force transmitted to the cutting bit (i.e., the "weight on bit", "WOB") is lost and no further drilling can be accomplished.

Furthermore, with the method of attachment of the '049 device—using a combination of bonding and pins to attach the metal end fitting to the composite pipe section—any failure during drilling from torsional loads will also destroy the axial load capability of the drill pipe and the pipe will separate.

Moreover, the overall capability of a bonded joint to transfer loads is limited due to the inherently different material properties between the composite and the steel end fitting. The steel end fitting cannot tolerate the strain range of the composite material. Because of this, the shear loading at the leading edge of composite to metal interface on a bonded fitting has a very high concentration of shear stress. As the axial load is increased, the magnitude of the local shear stress also increases. When the strength of the bond is exceeded in this local area, the bond fails locally and this failure quickly propagates along the entire length of the fitting. Attempts to increase the strength by adding an additional length to the interface are futile because the local concentration at the leading edge is minimally affected by an increased length and the over strength is relatively unimproved.

SUMMARY OF THE INVENTION

The present invention overcomes the above-noted and other problems in the existing art.

For example, the present invention can provide a reliable drill pipe that extends the reach of horizontal drilling operations. As another example, the present invention can provide an improved composite drill pipe where the density of the drill pipe is designed to reduce friction loss when immersed in drilling mud. As another example, the present invention can also provide an improved method of attaching a metal end fitting to a composite body—preferably, for a drill string used for drilling into ground surfaces. Further advantages and benefits of the improved attachment method are to provide increased axial strength, increased torsional strength, reduced cost and/or fail safe design.

According to one aspect of the invention, a composite drill pipe assembly includes a composite tubular pipe section having open opposite ends; a metal end fitting fittable within at least one of the opposite ends with the composite tubular pipe section surrounding the metal end fitting at an interface area; the metal end fitting having a plurality of annular grooves extending therearound within the interface area; the composite tubular pipe section having a plurality of annular grooves that interfit the annular grooves of the metal end fitting in the interface area.

According to another aspect of the invention, the annular grooves of the metal fitting are generally V-shape, the V-shape being defined in part by an inclined wall at a leading end of each the grooves. According to another aspect of the invention, at least some of the inclined walls proximate the trailing end have a larger angle than those proximate the leading end.

According to another aspect of the invention, the composite drill pipe section and the metal fitting also include corresponding axial grooves within the interface area.

According to another aspect of the invention, wherein the composite drill pipe includes outwardly extending nodal portions along the length of the composite pipe section to increase stability under axial compressive loads.

According to another aspect of the invention, a composite drill pipe assembly is provided that includes a composite tubular pipe section having open opposite ends; a metal end fitting fittable within at least one of the opposite ends, with the composite tubular pipe section surrounding the metal end fitting at an interface area; torsional load supporting means for supporting torsional loads between the metal end fitting and the composite pipe section; axial load supporting means for supporting axial loads between the metal end fitting and the composite pipe section; wherein the torsional load supporting means and the axial load supporting means are separate such that a failure of the torsional load supporting means will not interfere with the axial load support of the axial load supporting means. Preferably, the axial load supporting means includes a plurality of corresponding annular grooves in both the composite pipe section and the metal fitting.

According to another aspect of the invention, a method is provided which includes the steps of: providing a composite tubular pipe section having open opposite ends; locating a metal end fitting within one of the opposite ends with the composite tubular pipe section surrounding the metal end fitting at an interface area; supporting axial loads between the metal end fitting and the composite tubular pipe section with a plurality of annular grooves extending around the metal end fitting within the interface area and a corresponding plurality of annular grooves within the composite tubular pipe section that interfit the annular grooves of the metal end fitting in the interface area.

The above and other advantages, features and aspects of the present invention will be more readily perceived from the following description of the preferred embodiments thereof taken together with the accompanying drawings and claims.

BRIEF DESCRIPTION OF THE DRAWINGS

The present invention is illustrated by way of example and not limitation in the accompanying drawings, in which like references indicate like parts, and in which.

DETAILED DESCRIPTION OF THE PREFERRED EMBODIMENTS

Figure 1:
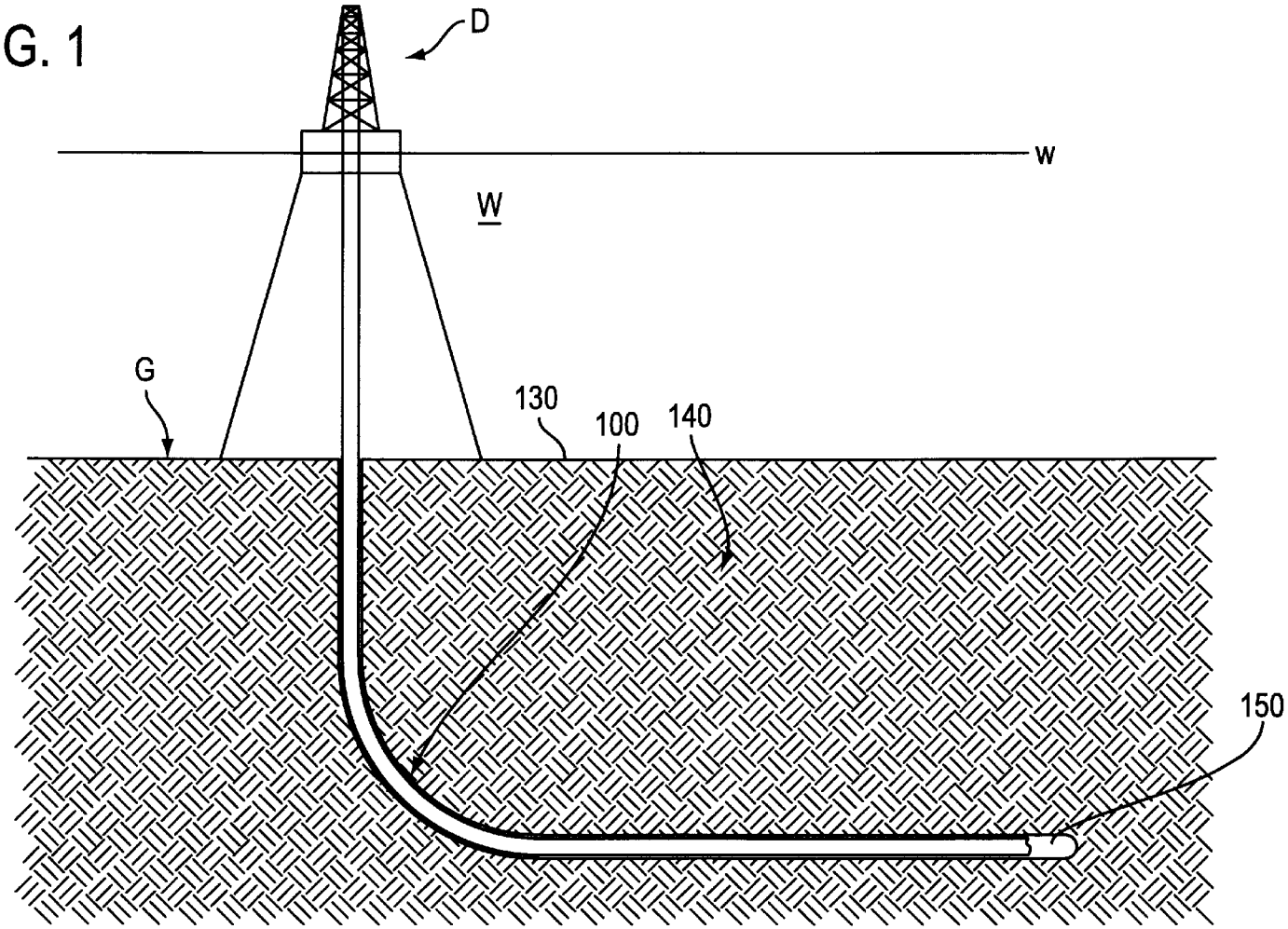
FIG. 1 is a partial cross-sectional view illustrating a drill string according to the invention extending into a bore in a ground surface.

The FIGS. illustrate preferred embodiments of the present invention. As shown in FIG. 1, the present invention can be used, for example, with a drill apparatus D used to drill into the ground G below a body of water W having a water level w. In the exemplary embodiments of the invention, a plurality of composite drill pipes 212 are connected together to form a flexible drill pipe string 100. The leading composite drill pipe 212 has a drill bit 150 at the foremost end. The composite drill pipes 212 can be made with known composite materials, such as, e.g., a fiber reinforced flexible synthetic material. A fiber reinforced flexible synthetic material can include, for example, carbon fibers, graphite fibers, fiberglass fibers, aramide fibers, etc. The fiber reinforced flexible synthetic material preferably includes a plurality of fiber layers. The fiber layers are preferably at varied angles to one another.

Figure 2A:
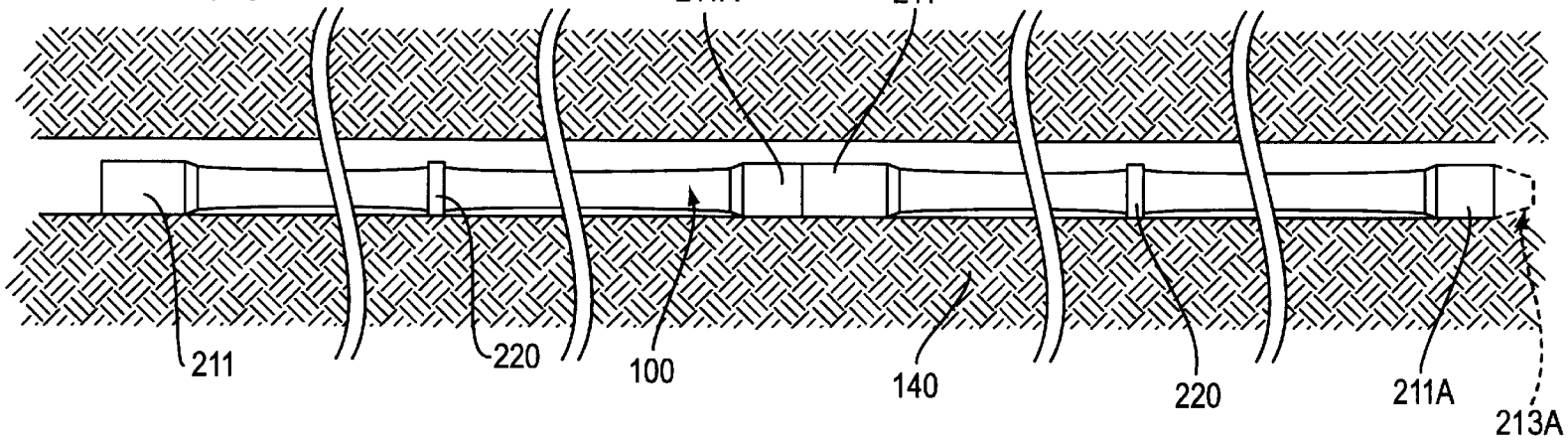
FIG. 2(A) is a side view of two connected composite sections inside a bore with node spacers for increasing the buckling resistance.
Figure 2C:
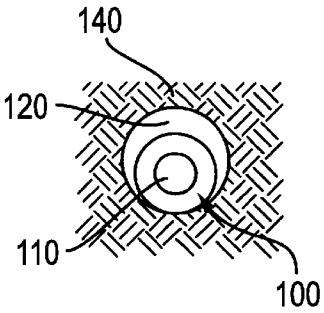
FIG. 2(C) is an end view of a composite section shown in FIG. 2(C)

To connect the drill pipes 212 as a drill string 100, metal fittings 211 are attached at opposite ends of each of the composite pipes 212. The metal fittings 211 have means to connect to other metal fittings 211 so enable the pipes 212 to be connected together in a string. For example, the leading ends of the pipes 212 can be connected to metal fittings 211A' having threaded male connecting portions 215A, FIGS. 2(A) and 2(B), and the trailing ends of the pipes 212 can be connected to metal fittings 211 having threaded female connecting portions 213, FIG. 3(A). These male and female threaded connecting portions can be connected together, for example, in a similar manner to that discussed in U.S. Pat. No. 5,332,049, column 2, lines 60, et seq., the entire disclosure of which is incorporated herein by reference. Other known connecting means for connecting the metal fittings together can be also used.

Figure 2B:
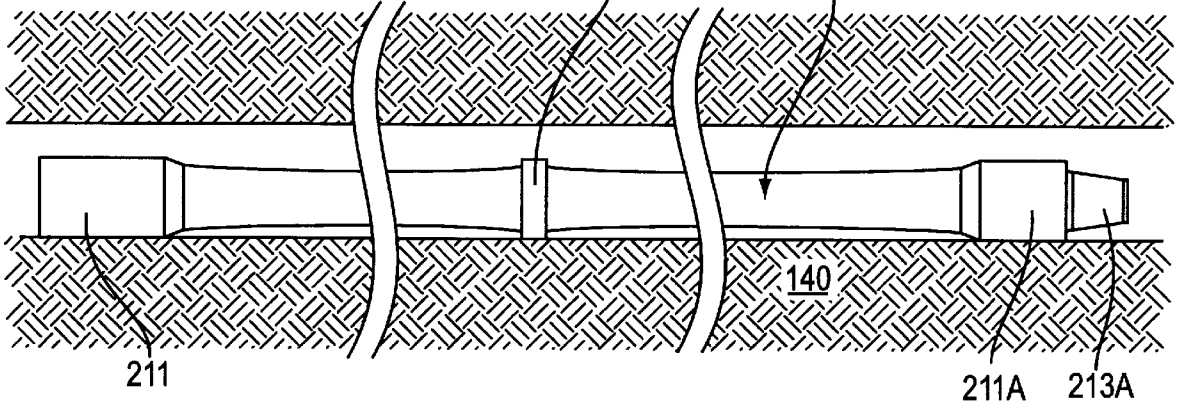
FIG. 2(B) is a side view of a single composite section of the drill string inside a bore.

Similar to the device of the '049 patent, a synthetic liner can also be used which extends through the center 110 to isolate the inner wall from fluid therein, and a wear resistant outer coating can also be used to shield the exterior from abrasive materials within the bore. In addition, as with the device of the '049 patent, each composite drill pipe 212 can have a length, as just one example, between 20 and 40 feet and a density of about 0.06 pounds per cubic foot to about 0.08 pounds per cubic inch. FIG. 2(B) illustrates one exemplary construction wherein a composite section 212 is about 24 feet long and other portions are sized as shown, in inches.

In operation, fluid (e.g., drilling mud) can be forced into the centers 110 of the connected pipes 212 to lubricate the drill bit 150 and to flush debris around the string 100 through the annulus 120 to the surface 130. During normal forward drilling operations, the pipe string 100 is subjected to both compression and torsion loads. The buoyancy of the composite drill pipe 100 within the drilling mud reduces the effective weight acting on the formation 140. This reduces the driving force required to push the cutting bit 150 into the formation 140.

The present invention provides an improved means for attaching a metal end fitting to a composite tubular member 212.

Figure 3A:
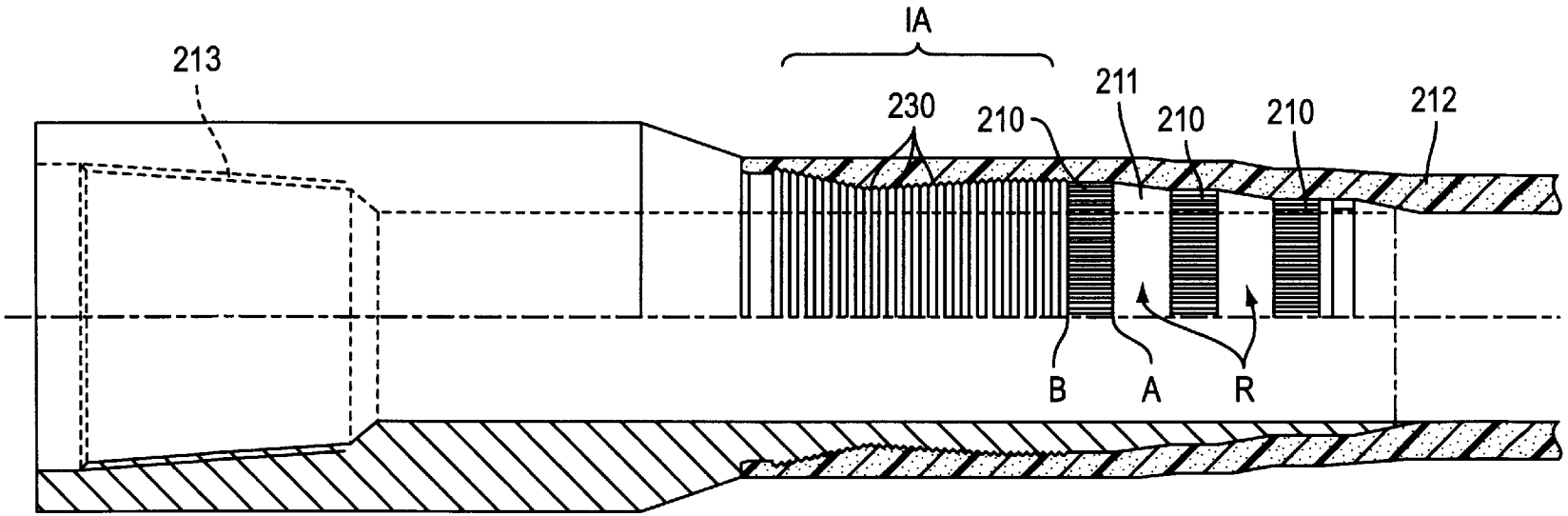
FIG. 3(A) is a partially cross-sectional side view showing an intersection area of a composite section and a metal fitting according to a preferred embodiment.
Figure 3B:
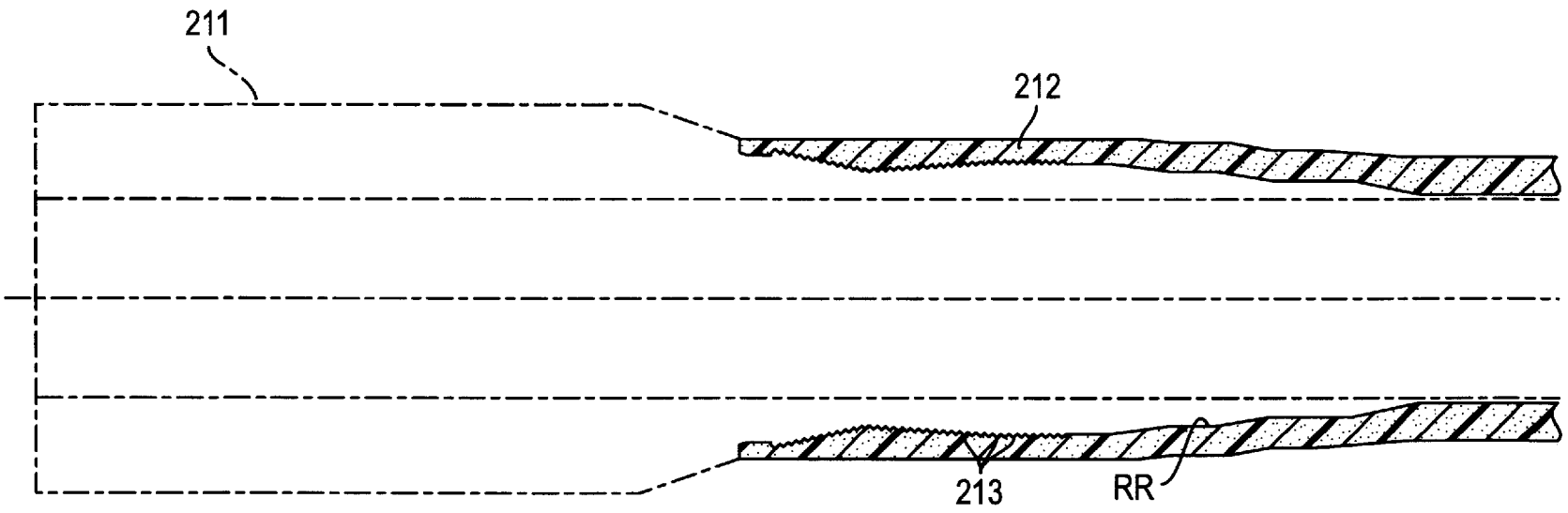
FIG. 3(B) is a partial cross-sectional side view showing an intersection area of a composite section according to a preferred embodiment.
Figure 4A:
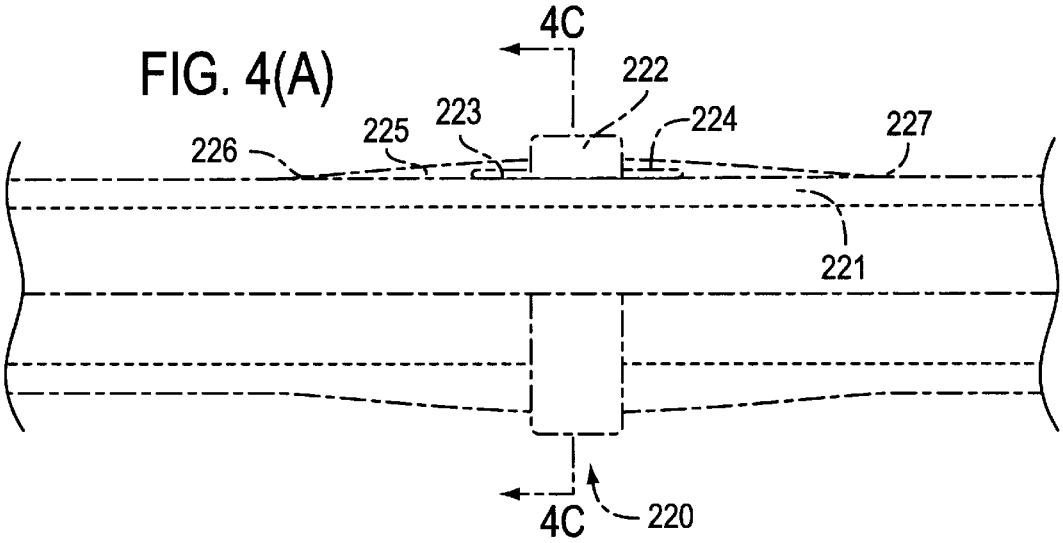
FIG. 4(A) is a cross-sectional side view of a preferred construction of a node spacer.
Figure 4B:
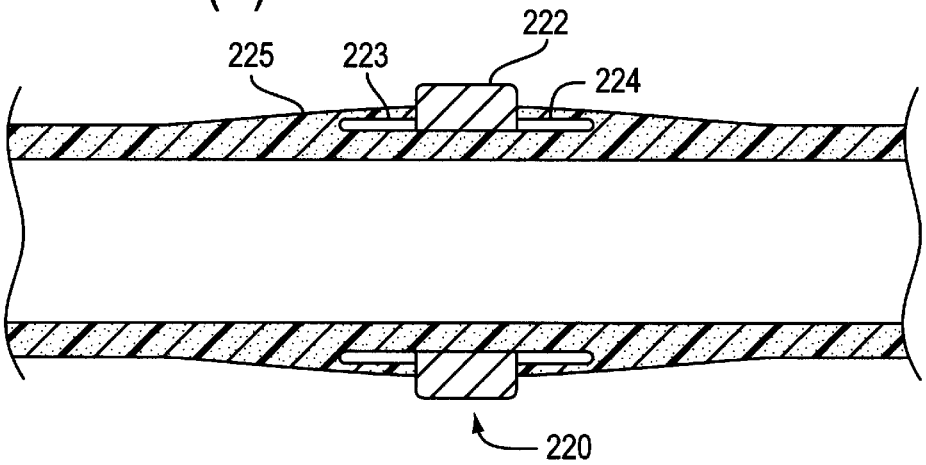
FIG. 4(B) is another cross-sectional side view of another construction of a node spacer.
Figure 4C:
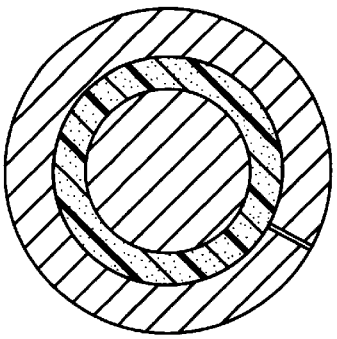
FIG. 4(C) is a cross-sectional end view of the node spacer shown in FIG. 4(A)

Compression loads are preferably transferred between the composite drill pipe section 212 and the metal fittings 211—at least in part—by a wedging action between the fittings 211 and respective pipe section 212 in the area(s) R shown in FIG. 3(A). Most preferably, the intersection between the metal fitting 211 includes one or more ramp portion R. Each ramp portion involves an angled region along the intersection between the composite section 212 and the metal fitting 211. As shown in FIG. 3(B), the composite section also includes a ramp portion RR corresponding to the ramp portion of the metal fitting. Preferably, the ramp portion(s) are tapered portions as shown.

Tension loads are preferably transferred by interface pressure and friction between interfitting grooves 230 and 231. In particulars the metal fitting 211 preferably includes a series of annular grooves 230 at an interface area IA between the metal fitting 211 and the composite pipe 212. The grooves 230 preferably include a plurality of individual grooves that extend circumferentially around the fitting 211, rather than a single spiral groove. Preferably, the grooves are located along generally parallel planes that are generally perpendicular to a center axis of the metal fitting. Preferably, the grooves are generally V-shaped. As shown in FIG. 3(B), the composite section 212 preferably includes grooves 231 that interfit and correspond to the grooves 230.

Figure 5A:
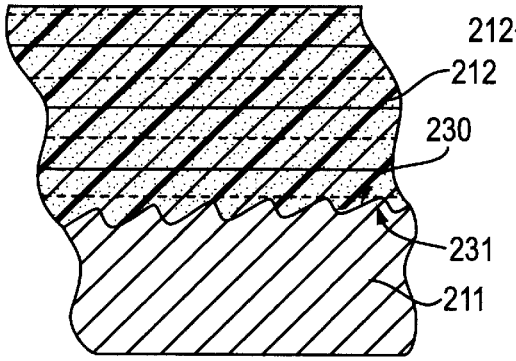
FIG. 5(A) is a cross-sectional side view showing the interfitting grooves in the absence of tension forces.
Figure 5B:
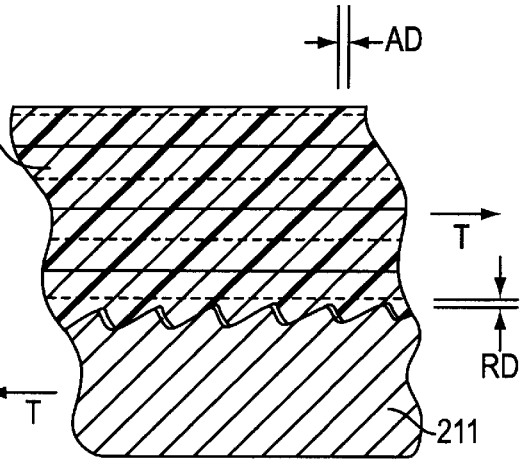
FIG. 5(B) is a cross-sectional side view showing the interfitting grooves in the presence of tension forces.
Figure 5C:
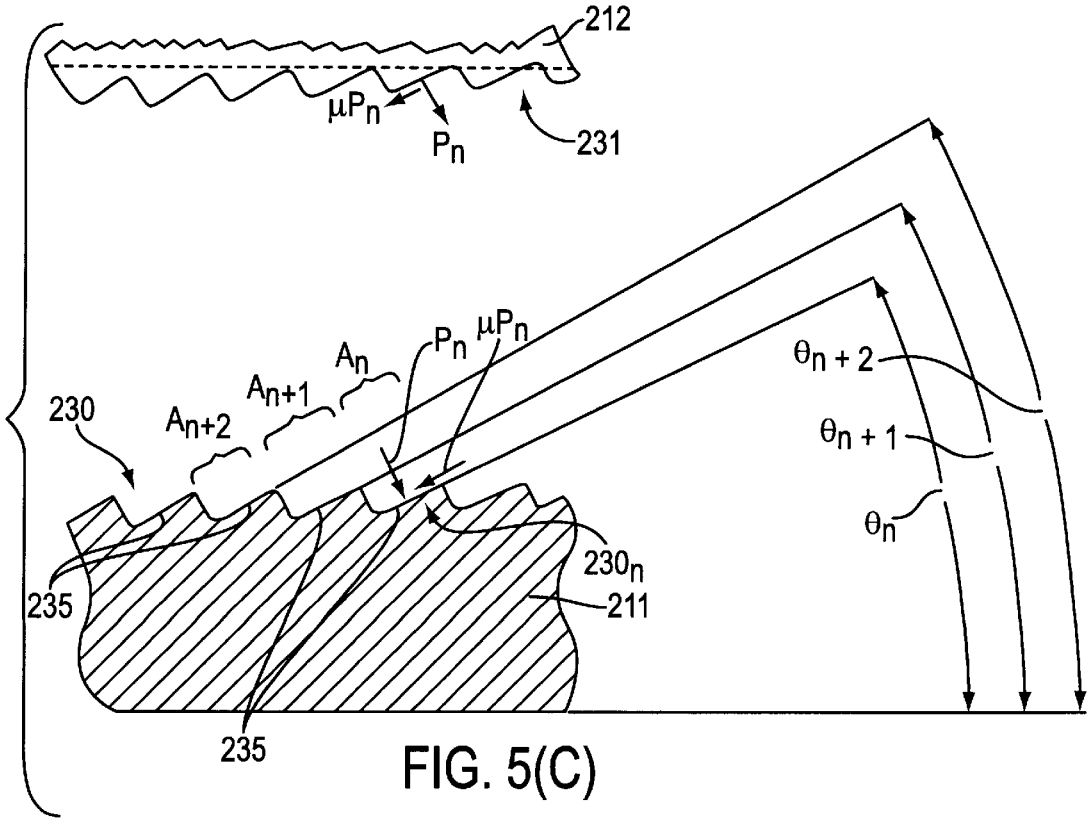
FIG. 5(C) is a schematic diagram showing the operation of the annular grooves.

The composite body 212 has a lower axial stiffness than the metal fitting 211, and the composite section stretches when an axial tension load T is applied to the pipe body. FIG. 5(A) illustrates a connection without a tension load T applied. FIG. 5(B) illustrates a connection with a tension load T applied. The grooves 230 preferably have inclined walls 235 that are arranged at predetermined ramp angles θ. The operation of these grooves 230 is now described with reference to a specific groove "n". As shown in FIG. 5(C), the ramp angle $\theta_n$ at a groove $\mathbf{230}_n$ on the metal fitting forces the composite to expand radially and thereby build an interface pressure $P_n$ between the composite and the fitting. That is, as the composite material is pulled axially, the material is also displaced radially a distance $RD_n$ by the ramp angle $\theta_n$. This radial displacement develops the interface pressure $P_n$ between the metal fitting 211 and the composite section 212. This interface pressure in turn develops the frictional forces $\mu P_n$ between the metal fitting 211 and the composite section 212 along the inclined walls 235. The interface pressure $P_n$ and the frictional force $\mu P_n$ act on the contact area $A_n$ and both have axial components of force $P_n \cdot A_n \cdot \mathrm{Sin}\theta_n$ and $P_n \cdot A_n \cdot \mathrm{Cos}\theta_n$, respectively. These axial forces acting on each groove transfer a portion of the tension load from the composite 212 into the fitting 211. The axial load at an adjacent subsequent groove is thereby reduced, and the axial displacement is correspondingly reduced. By increasing a ramp angle $\theta_{n+1}$ of an inclined wall $\mathbf{235}_{n+1}$ slightly over a ramp angle $\theta_n$ of an inclined wall $\mathbf{235}_n$, the radial interface pressure can be increased to control the amount of axial force acting on each groove.

Figure 5D:
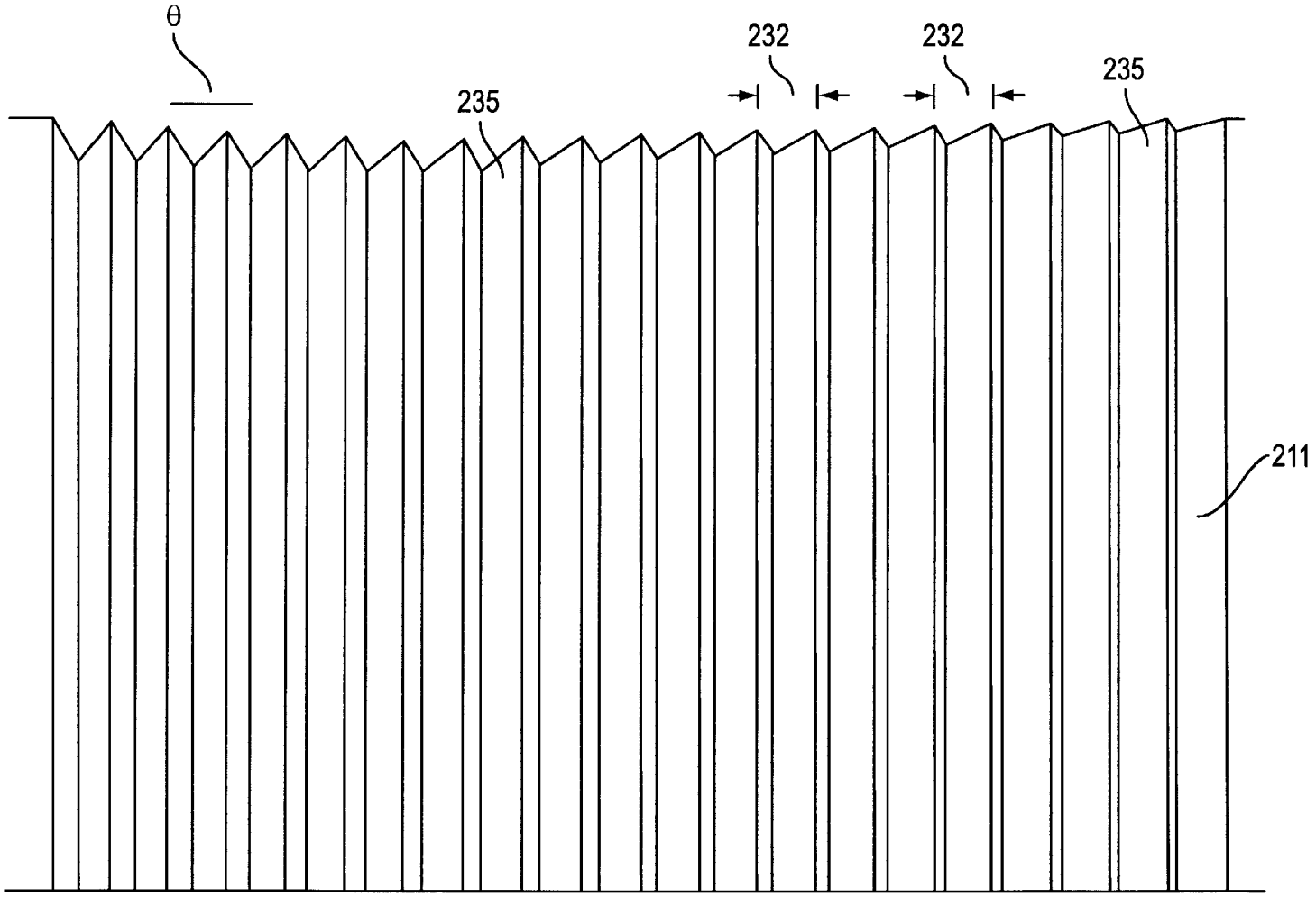
FIG. 5(D) is a side view of a part of the metal fitting showing grooves with varying ramp angles.

Preferably, the ramp angle θ at the leading edge, e.g., the rightmost edges shown in FIGS. 3(A) and 5(D), is the smallest and, thus, a relatively large displacement is permitted between members to create a certain amount of interface pressure. In this context, the term "leading" refers to the front direction of the metal fitting 211 toward a side connected to the composite section 212; a leading direction of a metal fitting 211A can be opposite to a leading direction of the metal fitting 211. As shown in FIG. 5(D), the ramp angle θ at subsequent grooves is preferably incrementally steeper to develop the interface pressure with reduced relative axial displacement AD between the composite section 212 and the metal fitting 211. The rate at which the ramp angle is increased controls the rate at which the loads are transferred. As a result, stress concentrations can be eliminated. In one preferred exemplary construction, the ramp angle at the leading edge is between about 5–20° and the ramp angle at the trailing edge is between about 45–65°. As shown in FIG. 5(D), the grooves at the leading edge are preferably shallower than at the trailing edge. FIG. 5(D) also illustrates one exemplary construction wherein the grooves have generally similar widths 232 in an axial direction.

In this manner, the shear stress developed in the composite body can be distributed uniformly over the entire available length of the fitting interface and any local concentration of shear stress—which is inherent with bonded joints—can be eliminated.

There is no limit as to the number of grooves that can be used for the interface, and the overall length of the interface can be extended as far as practical. Thus, very large loads can be transferred from a composite tubular structure to a metal end fitting.

In the most preferred embodiments, the torsional load is transferred through corresponding axial grooves in both the fitting 211 and the composite section 212. Nevertheless, it is contemplated that torsional loads could be treated in another manner.

The axial grooves 210 in the metal fitting 211 are preferably a series of V-shaped grooves distributed around the circumference of a metal fitting 211. The axial grooves 210 preferably have a groove angle which transitions from a low angle at the first point of contact (e.g., at a point A in FIG. 3) between the composite and metal end fitting up to a higher angle at the end of the axial groove (e.g., at a point B in FIG. 3). Rotation of the composite section 212 around the metal fitting 211 is inhibited due to interface pressure between the interfitted grooves.

The present invention has substantial benefits in the removal process of the drill string 100 from the well bore in the formation 140. If the cutting bit 150 or another part inside the bore becomes lodged or stuck, the tensile loads exerted on the drill string 100 can become very large.

One notable advantage of the present invention is the ability of the device to ensure that axial strength is separately maintained. For example, according to the preferred embodiments wherein both axial and annular grooves are included, a failure of the axial grooves to prevent rotational movement would not interfere with the axial strength of the device. Among other benefits, this ensures that the drill string can be fully removed from a bore despite a failure in torsional load capabilities. The use of annular grooves for axial loading can enable complete separation of any rotational or torsional loads, if desired. For example, the drill can continue to rotate for a period of time without jeopardizing axial load strength after a torsional load resisting ability has failed. Thus, one concept of the present invention is to separate load mechanisms for axial and torsional loads. Other means of separation could be used, but the illustrated embodiments are most preferred. For example, a different type of separate torsional load preventing means could be used (such as connecting pins, bolts, etc.). This separate torsional load preventing means could be used, e.g., in place of the axial grooves. With this separation, even if failure occurs under torsional loading, the axial strength of the pipe will be completely available to recover the drill string. This feature results in a "fail safe" drill pipe.

As noted, the present invention also helps to reduce strain and to increase the overall capability of a joint to transfer loads—despite differences in material properties between the composite sections 212 and the metal end fittings 211. For example, high concentrations of shear stress at the leading edge of the composite section 212 to metal fitting 211 interface can be avoided.

One preferred method of forming the grooves in the composite material involves prefabricating an appropriate metal fitting and then forming the composite section 212 around the metal fitting such that it conforms to the grooves in the metal fitting—e.g., a fiber reinforced synthetic resin can be placed around the metal fitting while in a malleable state and the resin can then assume the configuration of the grooves in the metal fitting. Another method of forming the grooves in the composite material involves forming the composite body 212 initially without grooves 231, and then placing the composite body around the metal fitting with a filler material in between the composite body and the metal fitting. The filler material being a material that will conform to the grooves 230 in the metal fitting and that will adhere to the composite material without adhering to the metal fitting. For example, the filler material can include appropriate adhesives and the like. In this latter method, the composite body could be formed into a composite shell with an undersized end opening, then an end of the composite shell can be machined to have an appropriate bore diameter to receive the metal fitting and then the filler material can be used to form the grooves 231 as described. As discussed above, the composite material is preferably not directly adhered to the metal fitting to avoid interference with the operation of the interfitting grooves which involves a degree of axial displacement.

The stability of the pipe 100 to support a compression load is preferably increased by the use of node portions 220 spaced along the length of each pipe section. Although less preferred, the present invention could be practiced without such portions. The node portions 220 preferably include an abrasion resistant material extending around the periphery of the pipe 100. The node portions 220 are preferably made as a three piece assembly, with an underlying compliant rubber layer 221, an abrasion resistant ring 222 (preferably an abrasion resistant metal ring) having outward leg portions 223 and 224, and a secondary composite structure 225 fabricated over the legs 223 and 224 of the ring 222. The extremities 226 and 227 of the secondary composite structure preferably extend well beyond the ends of the legs 223 and 224, respectively. The composite structure 225 can include, e.g., a build-up of both glass and graphite fibers. Preferably, an adhesive bonding is provided between the rubber layer and the abrasion resistant ring 222. The node portions reduce the effective buckling node spacing and thereby increase the axial load capability.

Although the most preferred embodiments of the present invention pertain to composite drill pipes having metal end fittings and composite sections, concepts of the invention can be applied to other materials and other connections. For example, such annular grooves, etc., could be used to connect drill pipes or the like having non-metal rigid end fittings that connect flexible sections which are not fiber reinforced, e.g., synthetic polymers or the like.

While the present invention has been shown and described with reference to preferred embodiments presently contemplated as best modes for carrying out the invention, it is understood that various changes may be made in adapting the invention to different embodiments without departing from the broader inventive concepts disclosed herein and comprehended by the claims which follow.

What is claimed is:

1. A composite assembly for improved load transmission, comprising:

a composite tubular pipe section having opposite ends;

a metal end fitting fittable to at least one of said opposite ends with said composite tubular pipe section connected to said metal end fitting at an interface area;

said metal end fitting having a plurality of annular grooves within the interface area;

said composite tubular pipe section having a plurality of annular grooves that interfit said annular grooves of said metal end fitting in the interface area; and wherein at least some of said annular grooves of said metal end fitting proximate a trailing edge of said metal end fitting have a larger angle than those proximate a leading edge of said metal fitting.

2. The composite assembly of claim 1, wherein said annular grooves of said metal fitting are generally V-shape, said V-shape being defined in part by an inclined wall at a leading end of each of said annular grooves of said metal fitting.

3. The composite assembly of claim 2, wherein said composite pipe section and said metal fitting also include corresponding axial grooves within said interface area.

4. The composite assembly of claim 1, wherein said interface area includes at least one ramp portion for imparting a compression load.

5. The composite assembly of claim 1, wherein said composite tubular pipe and said metal end fitting are components of a drill pipe.

6. The composite assembly of claim 1, wherein said composite tubular pipe surrounds said metal end fitting at said interface area, said annular grooves of said composite tubular pipe being internal grooves and said annular grooves of said metal end fitting being external grooves.

7. The composite assembly of claim 1, wherein said composite tubular pipe has a hollow central core.

8. A composite assembly for improved load transmission, comprising:

a composite tubular pipe section having opposite ends;

a metal end fitting fittable to at least one of said opposite ends with said composite tubular pipe section connected to said metal end fitting at an interface area;

said metal end fitting having a plurality of annular grooves within the interface area, said annular grooves being generally V-shape, said V-shape being defined in part by an inclined wall at a leading end of each of said grooves;

said composite tubular pipe section having a plurality of annular grooves that interfit said annular grooves of said metal end fitting in the interface area; and wherein said composite pipe includes outwardly extending nodal portions along the length of the composite pipe section to increase stability under axial compressive loads.

9. The composite assembly of claim 8, wherein said composite tubular pipe and said metal end fitting are components of a drill pipe.

10. A composite assembly for improved load transmission, comprising:

a synthetic tubular pipe section having opposite ends;

a rigid end fitting fittable to at least one of said opposite ends with said synthetic tubular pipe section connected to said rigid end fitting at an interface area;

said rigid end fitting having a plurality of annular grooves within the interface area;

said synthetic tubular pipe section having a plurality of annular grooves that interfit said annular grooves of said rigid end fitting in the interface area; and wherein said plurality of annular grooves in said rigid end fitting have inclined walls with varying angles which are increased in a trailing direction between at least some adjacent grooves of said plurality of annular grooves in said rigid end fitting.

11. The composite assembly of claim 10, wherein said inclined walls vary from between about 5–20° at a leading end to about 45–65° at a trailing end.

12. The composite assembly of claim 10, wherein said synthetic tubular pipe and said rigid end fitting are components of a drill pipe.

13. The composite assembly of claim 10, wherein said synthetic tubular pipe includes fiber reinforcement and said rigid end fitting is made of metal.

14. The composite assembly of claim 10, wherein said synthetic tubular pipe surrounds said rigid end fitting at said interface area, said annular grooves of said synthetic tubular pipe being internal grooves and said annular grooves of said rigid end fitting being external grooves.

15. A composite assembly for improved load transmission, comprising:

a composite tubular pipe section having opposite ends;

a metal end fitting fittable to at least one of said opposite ends, with said composite tubular pipe section connected to said metal end fitting at an interface area, said metal end fitting having a plurality of annular grooves at said interface area;

torsional load supporting means for supporting torsional loads between said metal end fitting and said composite pipe section;

axial load supporting means for supporting axial loads between said metal end fitting and said composite pipe section;

wherein said torsional load supporting means and said axial load supporting means are separate such that a failure of said torsional load supporting means will not interfere with the axial load support of said axial load supporting means; and wherein said annular grooves in said metal fitting have predetermined varying ramp angles which are increased in a trailing direction between at least some adjacent grooves of said plurality of annular grooves of said metal fitting.

16. The composite assembly of claim 15, wherein said axial load supporting means includes a plurality of annular grooves in said composite pipe section.

17. The composite assembly of claim 15, wherein said composite tubular pipe and said metal end fitting are components of a drill pipe.

18. The composite assembly of claim 15, wherein said composite tubular pipe surrounds said metal end fitting at said interface area, said annular grooves of said composite tubular pipe being internal grooves and said annular grooves of said metal end fitting being external grooves.

19. A method of attaching a generally flexible tubular section to a substantially rigid end fitting for improved load transmission, comprising the steps of:

providing a generally flexible tubular section having opposite ends;

connecting a substantially rigid end fitting to one of said opposite ends with said tubular section fitted to said end fitting at an interface area;

supporting axial loads between said end fitting and said tubular section with a plurality of annular grooves in the end fitting within the interface area and a corresponding plurality of annular grooves in the tubular section that interfit said annular grooves of said end fitting in the interface area; and further including the step of providing at least some of said plurality of annular grooves in said end fitting with selectively varied ramp angles which are increased in a trailing direction between at least some adjacent grooves of said plurality of annular grooves in said end fitting.

20. The method of claim 19, further including the step of supporting torsional loads between said tubular section and said end fitting via corresponding axial grooves within said interface area.

21. The method of claim 19, further including the step of increasing stability under axial compressive loads via outwardly extending nodal portions along the length of the tubular section.

22. The method of claim 19, wherein said tubular section and said end fitting are provided as components of a drill pipe.

23. The method of claim 19, wherein said tubular section is provided surrounding said end fitting at said interface area, said annular grooves of said tubular section being internal grooves and said annular grooves of said end fitting being external grooves.

24. The method of claim 19, wherein said end fitting is a metal end fitting and said tubular section is a composite tubular pipe.

25. The method of claim 19, wherein said interface area is substantially free of adhesion or attachment such that axial loads can impart slight axial movement in the interface area between the end fitting and the tubular section.

26. The method of claim 19, wherein said tubular section is provided with a flexible synthetic material.

27. The method of claim 19, wherein said tubular section is provided with fiber reinforcing said flexible synthetic material.

* * * * *